US006752650B1

(12) United States Patent
Lin

(10) Patent No.: US 6,752,650 B1
(45) Date of Patent: Jun. 22, 2004

(54) CONNECTOR MARKED WITH POLARITY

(76) Inventor: Jia-Sheng Lin, P.O. Box 2-10, Tainan City (TW)

( * ) Notice: Subject to any disclaimer, the term of this patent is extended or adjusted under 35 U.S.C. 154(b) by 0 days.

(21) Appl. No.: 10/634,187

(22) Filed: Aug. 1, 2003

(51) Int. Cl.[7] ..... H01R 3/00
(52) U.S. Cl. ..... 439/491; 439/677; 439/461
(58) Field of Search ..... 439/351, 352, 439/353, 674, 675, 677, 488, 491, 460, 461

(56) References Cited

U.S. PATENT DOCUMENTS 5,334,044 A * 8/1994 Falossi et al. ..... 439/491
5,529,513 A * 6/1996 Lee ..... 439/491
D434,003 S * 11/2000 Brisson ..... D13/146

* cited by examiner

*Primary Examiner*—Tho D. Ta
*Assistant Examiner*—James R. Harvey

(57) ABSTRACT

A connector marked with polarity includes a front body, a terminal base, a cable constrictor and a colored ring. The front body has a small diameter portion, a smooth annular surface portion, a male threaded rear end portion and a center lengthwise hole for the terminal base and the cable constrictor to fit therein. The rear body has female threads to engage the male threads of the front body. The cable constrictor constricts a cable placed in its interior. Then the colored ring is fitted around the small annular surface portion of the front body and constricted by the rear body after combined with the front body. The colored ring has various colors for marked polarity of the connector so as to discern the connector and the correct cable to match with.

2 Claims, 5 Drawing Sheets

CONNECTOR MARKED WITH POLARITY

FIELD OF THE INVENTION

This invention relates to a connector marked with polarity, particularly to one easily discernible in its polarity so as to facilitate its connection with cables.

BACKGROUND OF THE INVENTION

A conventional connector shown in FIG. 1 includes a front body (A), terminals (not shown), a wire constrictor (not shown), and a rear body (B) as main components.

The front body (A) contains a wire constrictor and the terminals in its interior and combined with the rear body (B).

As the front body (A) of the conventional connector is made of metal, and generally colored silver, and the front end portion (B0) of the rear body (B) is also made metal of the same color as the front body (A),:and the rear constrict portion (B1) is made of plastic, generally colored black to correspond with the color of cables.

When many cables are used for connecting various connectors, discerning which cables belong to which connector is quite difficult owing to the same color of the cables and conventional connectors, with large possibility to misconnect cables with connectors in case of carelessness. If worse, disconnect a cable from some connector may cause the whole system going dead, resulting in great annoying.

SUMMARY OF THE INVENTION

The invention has been devised to offer a connector marked with polarity to be conveniently connected with a correct cable.

The feature of the invention is as follows.

1. The connector has a color ring for discerning its polarity, easy to match with a correct cable.
2. The connector has a color ring between the front body and the rear body, easy to discern its polarity.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
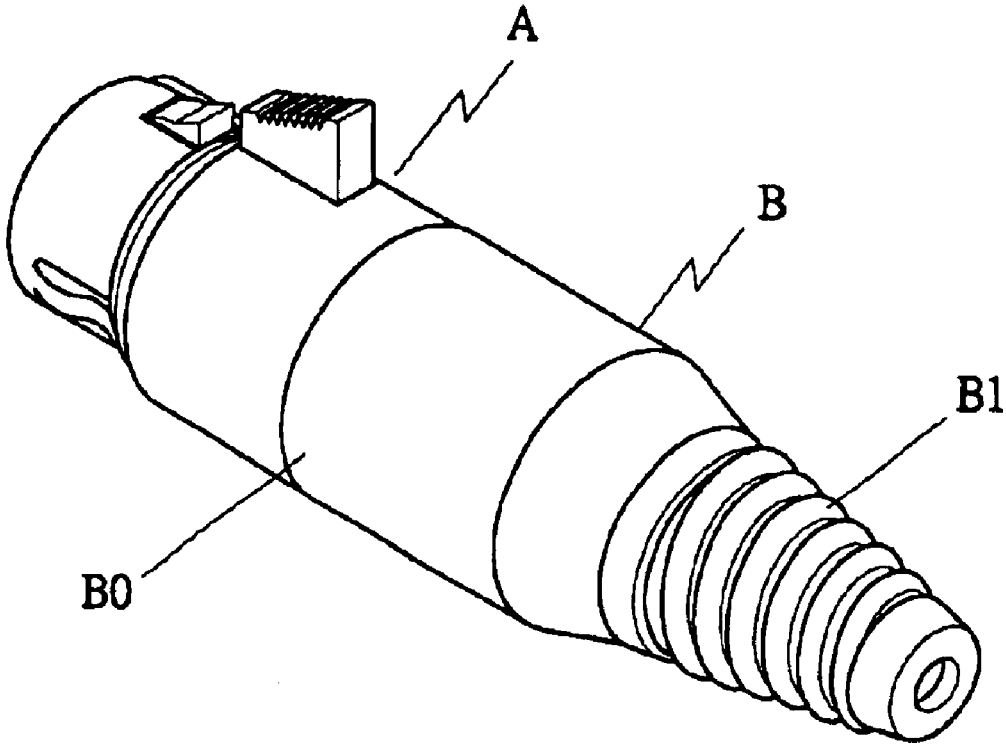
FIG 1 (PRIOR ART)
FIG. 1 is a perspective view of a conventional connector.
Figure 2:
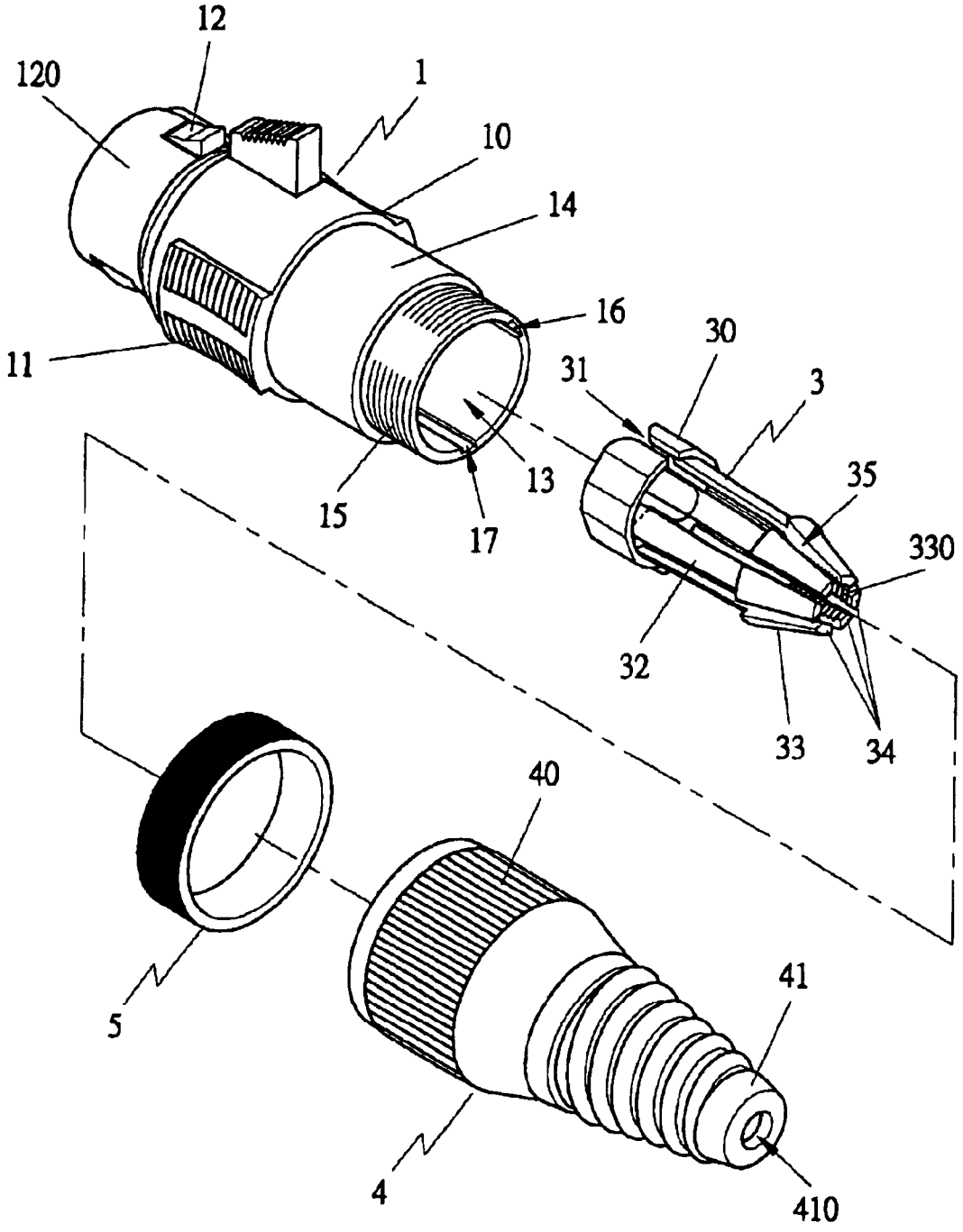
FIG. 2 is an exploded perspective view of a connector marked with polarity in the present invention.
Figure 3:
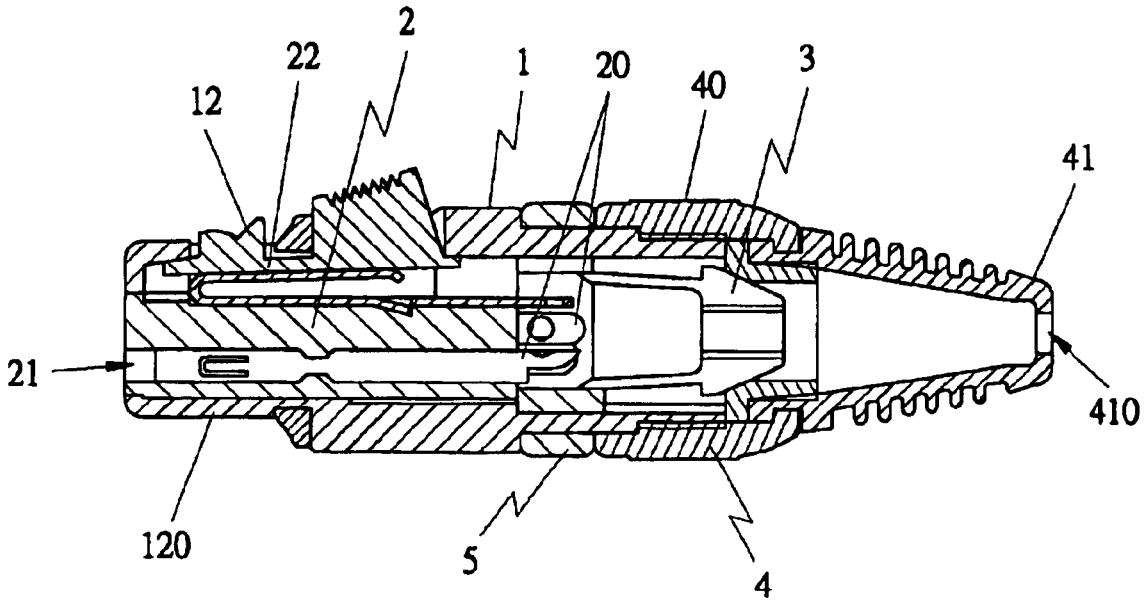
FIG. 3 is a cross-sectional view of the connector marked with polarity in the. present invention.
Figure 4:
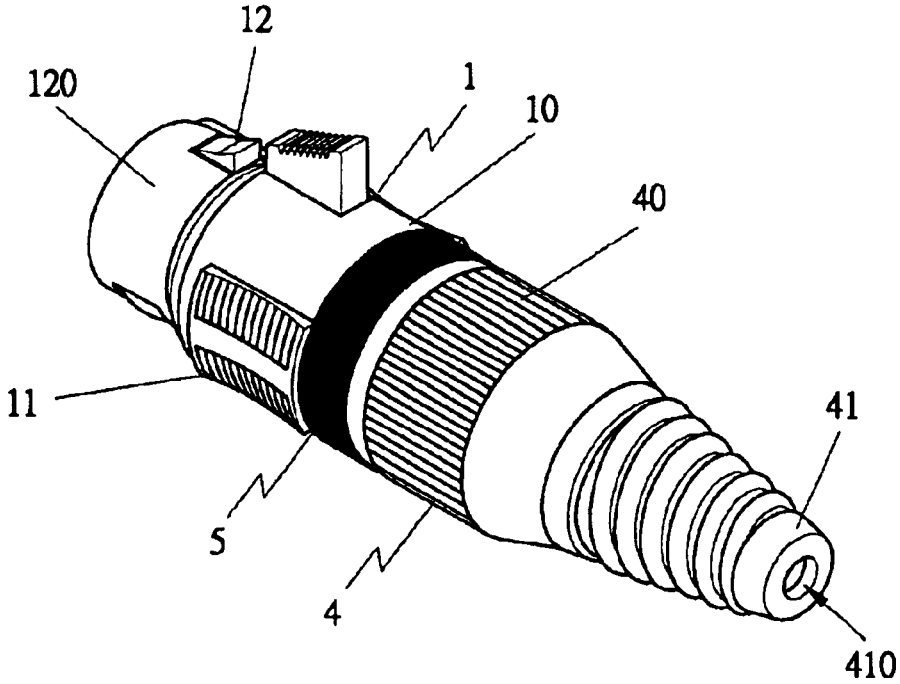
FIG. 4 is a perspective view of the connector marked with polarity in the present invention.

A first preferred embodiment of a connector marked with polarity in the present invention, as shown in FIGS. 2, 3 and 4, includes a front body 1, a terminal base 2, a wire constrictor 3, a rear body 4 and a colored ring 5 as main components.

The front body 1 has a grip circumferential portion 10, a grip surface 11 for a user to grip tightly, a button 12 on an outer surface of a front end portion 120, which is used for connecting another connector, a center lengthwise hole 13 for receiving the terminals 2 and the wire constrictor 3 therein. Further, the front body 1 has a smooth annular surface 14 in an intermediate portion, and male threads 15. The smooth annular surface 14 has a comparatively large space, shortening the distance for the male threads 15 engaging with female threads of the rear body 4 so as to save force in combining the front body 1 with the rear body 4. Further, two opposite lengthwise grooves 16, 17 are provided in an inner wall defining the center hole 13 so that the wire constrictor 3 may be inserted in a definite direction in the front body 1, keeping the terminal base 2 from rotating randomly.

The terminal base 2 has a positive terminal 20 inserted in a terminal hole 21 and a negative terminal 22 fixed firmly with the terminal base 2. Then the positive 22 and the negative terminal 22 both have their outer end welded with cables.

The wire constrictor 3 has a circumferential end portion 30 with outer multi-sides and an inner circular wall being smooth, and a gap 31 for the negative terminal 22 to fit therein, a small diameter annular portion 32 behind the end portion 30, and a cone-shaped end portion 33 behind the small diameter annular portion 32. The cone-shaped end portion 33 has inner teeth 330 for tightly constricting a cable, and the small diameter annular portion 32 and the cone-shaped end portion 33 both have six constrict rods 34 so as to reduce counter tension so that the cable may be constricted with less force. Moreover, the small diameter annular portion 32 is a little recessed than the other end portions 30 and 35 so the inner walls of the small diameter annular portion 32 may contact the outer surface of a cable closely. Further, the cable constrictor 3 has a lengthwise gap 35 for easily forced to open wider for a cable to be put into the cable constrictor 3 with little force.

The rear body 4 has an annular wrinkled surface 40 for favorably gripping to rotate, and a constrict end 41 with a hole 410 for a cable to pass through out.

The colored ring 5 is fitted around the smooth annular surface 14 of the front body 1, and kept lightly at its position by the rear body 4, as shown in FIGS. 3 and 4. The colored ring 5 may be colored variously to permit connectors look different from one another, then differently colored connectors can be easily connected with correct cables respectively, avoiding connecting a wrong cable to cause the system to go dead.

Figure 5:
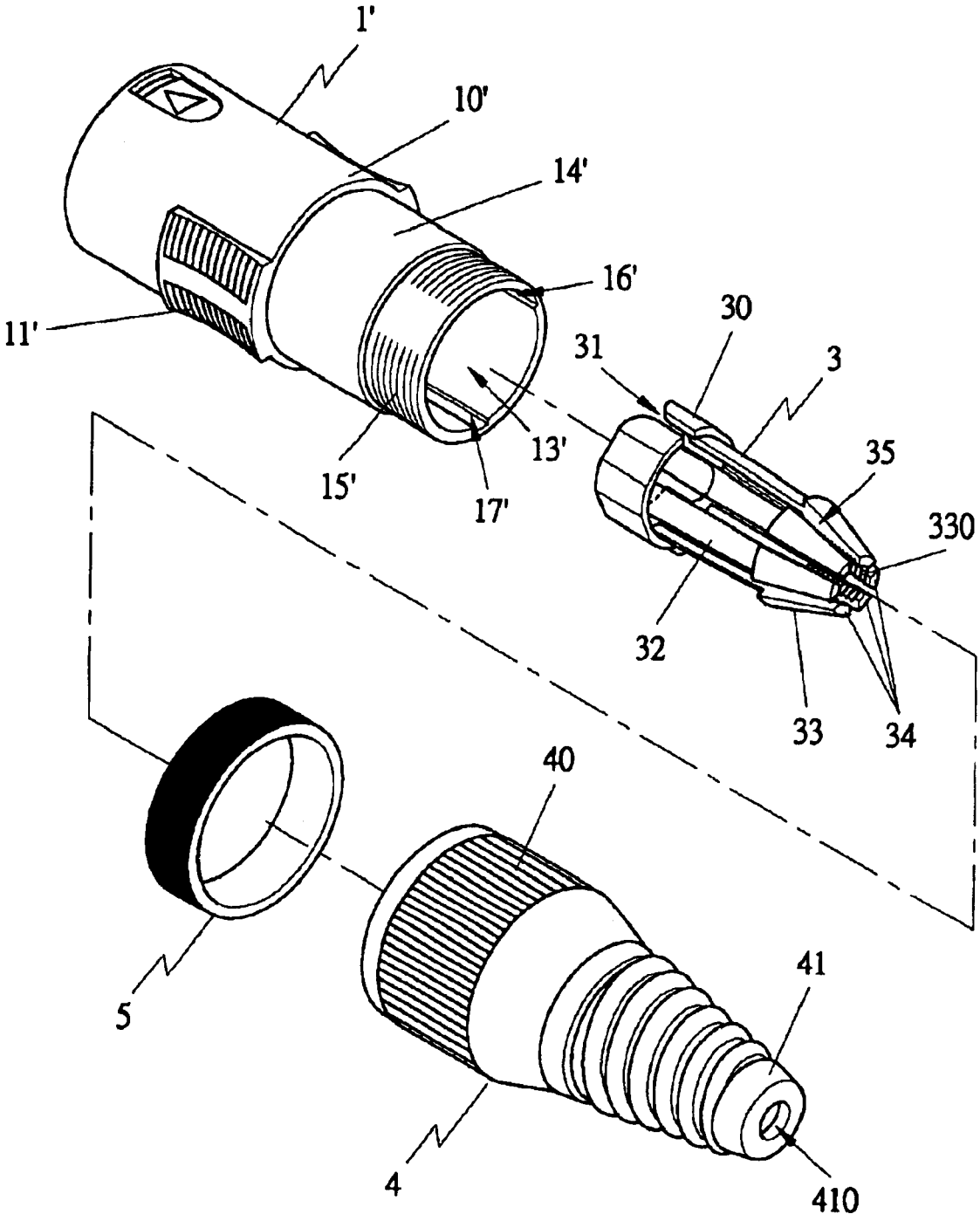
FIG. 5 is an exploded perspective view of a second embodiment of a connector marked with polarity in the present invention.
Figure 6:
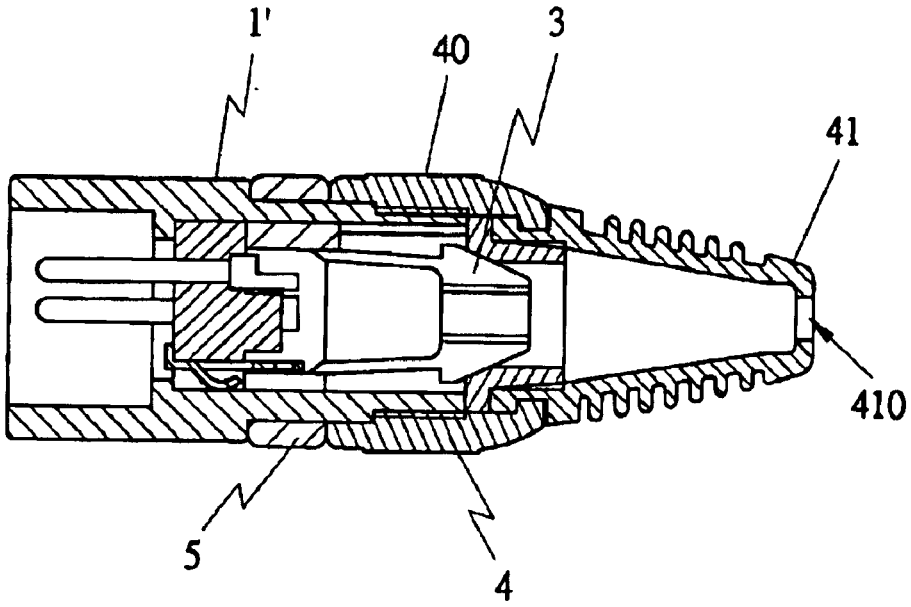
FIG. 6 is a cross-sectional view of the second embodiment of a connector marked with polarity in the present invention.
Figure 7:
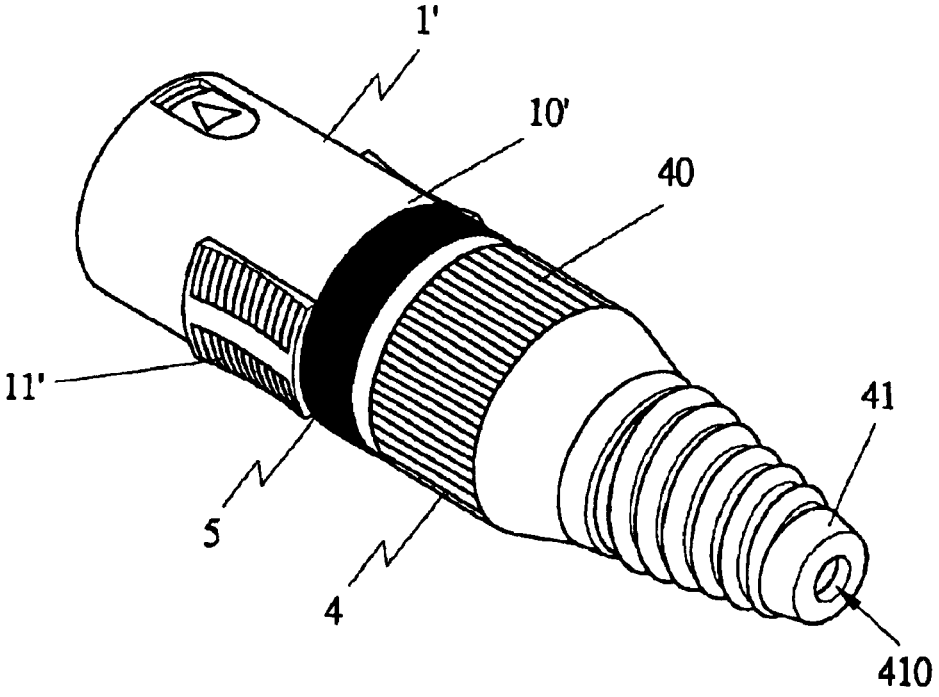
FIG. 7 is a perspective view of the second embodiment of a connector marked with polarity in the present invention.

Next, FIGS. 5, 6 and 7 show a second preferred embodiment of a connector marked with polarity, which has a front body 1', a terminal base 2', a cable constrictor 3', a rear body 4' and a colored ring 5' as main components.

The front body 1' has a grip circumferential portion 10', a grip surface 11', a center lengthwise hole 12', a smooth annular portion 14', male threads 15' and two opposite lengthwise grooves 16', 17' just like those in the front body 1 in the first preferred embodiment except the button 12.

The terminal base 2', the cable constrictor 3', the rear body 4' and the colored ring 5' are all the same as those in the first preferred embodiment.

In general, the connector marked with polarity according to the invention has an advantage of quickly identifying a connector and a cable to match with by a user, of increasing speed of maintenance and repair, and of correctness in connecting a connector with a cable.

While the preferred embodiments of the invention have been described above, it will be recognized that various modifications may be made therein and the appended claims are intended to cover all such modifications that may fall within the spirit and scope of the invention.

What is claimed is:

1. A connector marked with polarity comprising:

a front body having a grip annular portion with a grip surface for convenience of gripping by a user, a button formed on an outer surface, a front end portion to connect a different connector, a center lengthwise hole for receiving a terminal base and a cable constrictor therein, a smooth annular portion formed in an intermediate portion, male threads formed in a rear end portion, two opposite lengthwise grooves formed in an inner wall of said center lengthwise hole, said cable constrictor fitting in a definite direction in said two lengthwise grooves for said terminal base and said cable so that said terminal base may not rotate randomly;

said terminal base having plural holes for terminals to fit therein, said terminals having their outer ends welded with wires of a cable;

said cable constrictor having an inner annular end portion with outer multi-sides, an inner circular wall and a gap for receiving said negative terminal therein, a small diameter annular portion formed in an intermediate portion and having a longer length than said inner annular end portion, and a cone-shaped outer end portion provided with an inner toothed surface for tightly constricting a cable, said small diameter annular portion and said cone-shaped outer end portion both having six constrict rods, and a lengthwise groove for easily forced open to put a cable in said cable constrictor;

a rear body having a outer wrinkled portion for tightly gripping for a user to rotate said rear body, female threads engaging with said male threads of said front body, and a constrict end with a center hole for a cable to pass through out; and, a colored ring fitting around said smooth annular portion of said front body and tightly pinched by said rear body, said colored ring having different colors for discerning its polarity so as to connect with a correct cable.

2. A connector marked with polarity comprising:

a front body having a center lengthwise hole for receiving a terminal base and a cable constrictor therein, an outer smooth annular portion and male threads, two opposite grooves formed in an inner wall defining said center lengthwise hole for said terminal base and said cable constrictor to fit therein in a definite direction to keep said terminal base from rotating randomly;

said terminal having plural holes for terminals to fit therein, said terminals having their outer ends welded with wires of a cable;

said cable constrictor constricting a cable fitted in its interior;

a rear body having an outer wrinkled surface for tightly holding for a user to rotate said rear body to combine with said front body, an outer constrict end with a center hole for a cable to pass through out; and, a colored ring fitting around said outer smooth annular portion of said front body and tightly pinched by said rear body, said colored ring having different colors to mark its polarity for discerning so as to connect with a correct cable.

* * * * *